US007262687B2

(12) United States Patent
Nelson

(10) Patent No.: US 7,262,687 B2
(45) Date of Patent: Aug. 28, 2007

(54) SYSTEM AND METHOD FOR TRACKING PERSONNEL

(75) Inventor: Julie S. Nelson, San Antonio, TX (US)

(73) Assignee: Smith Legacy Security LLC, San Antonio, TX (US)

( * ) Notice: Subject to any disclaimer, the term of this patent is extended or adjusted under 35 U.S.C. 154(b) by 378 days.

(21) Appl. No.: 10/881,168

(22) Filed: Jun. 30, 2004

(65) Prior Publication Data

US 2005/0035863 A1 Feb. 17, 2005

Related U.S. Application Data

(60) Provisional application No. 60/489,234, filed on Jul. 22, 2003.

(51) Int. Cl.
*G08B 9/00* (2006.01)

(52) U.S. Cl. ..... 340/286.01; 340/286.02; 340/573.1; 340/573.4; 340/539.13; 340/539.15; 342/357.07; 342/357.13; 342/457

(58) Field of Classification Search ..... 340/286.01, 340/286.02, 573.1, 573.4, 539.13, 539.17; 342/357.07, 357.13, 457, 357.17
See application file for complete search history.

(56) References Cited

U.S. PATENT DOCUMENTS 5,742,233 A * 4/1998 Hoffman et al. ..... 340/573.1
5,905,461 A * 5/1999 Neher ..... 342/357.07
6,243,039 B1 * 6/2001 Elliot ..... 342/457

* cited by examiner

*Primary Examiner*—Tai Nguyen
(74) *Attorney, Agent, or Firm*—DuBois, Bryant & Campbell LLP; William D. Wiese

(57) ABSTRACT

A method and system for tracking the presence of persons, particularly security personnel, at a predetermined location within a prescribed window of time. Persons input information at predetermined locations and this input information is transmitted to a central server. The input information is compared to predetermined parameters and alerts are provided if the input information does not fall within permissible parameters.

2 Claims, 3 Drawing Sheets

SLS Interactor Report
For XYZ Security Company
System Administrator: Bob Jones

Client:
Post:
Date:
Time Frame:

| Employee Name | Time | Inspection Site | Detail |
|---|---|---|---|
| Holmes, Steve | 0800 | Officer Break Room | On Duty |
| Holmes, Steve | 0829 | West Door, 1st floor | See Report |
| Holmes, Steve | 0846 | East Elevator 3rd floor | Inspection |
| Holmes, Steve | 0903 | Boiler Room 6th floor | See Incident |
| Holmes, Steve | 0917 | Managers Office Back Door | Inspection |
| Holmes, Steve | 0923 | Janitorial Room 1st floor | Inspection |
| Holmes, Steve | 1001 | Officer Break Room 3rd floor | Inspection |
| Holmes, Steve | 1019 | Main Entrance 1st flkoor | Inspection |
| Holmes, Steve | 1033 | Xylon Office 5th floor | Inspection |
| Holmes, Steve | 1045 | Officer Break Room | On Break |
| Holmes, Steve | 1100 | | On Duty |

*FIG. 3*

SYSTEM AND METHOD FOR TRACKING PERSONNEL

REFERENCE TO RELATED APPLICATION

This non-provisional application claims priority based upon prior U.S. Provisional Patent Application Ser. No. 60/489,234 filed Jul. 22, 2003 in the name of Julie Smith Nelson, entitled "SYSTEM AND METHOD FOR TRACKING SECURITY PERSONNEL."

FIELD

The present invention pertains to a system and method for verifying the security services provided by security personnel; more particularly, the present invention pertains to a system for reporting the visits of security personnel at a watch station and providing real time alert when such activity does not meet a predetermined schedule or plan.

BACKGROUND

The use of security personnel to provide security watch services for factories, offices, buildings, and a wide variety of other institutions is a practice which goes back hundreds of years in the United States. To assure that security personnel complete their required number of appointed rounds at predetermined time intervals, a variety of verification systems have been proposed. Well known by many, and still in practice at many locations, is the use of a clocking device carried by security personnel to an array of predetermined locations (watch stations). As security personnel make their rounds, a device, typically a key located at the watch stations to be visited, is inserted into the clocking device. Each insertion of the key into the clocking device is recorded. A record extracted from the clocking device enables the security supervisor to verify that the security personnel visited predetermined locations within predetermined windows of time. While the use of a clocking device and watch station keys have been in use for many years, the problem still remains that the reporting of the rounds of the security personnel is delayed by the time necessary to physically secure the clocking device and then download and review the information describing the insertion of watch station keys into the clocking device. The most critical time for determining if security personnel have missed a watch station within a predetermined window of time is just after the watch station has been missed—not hours or days later. A need remains, therefore, for a system that provides a real-time alert to a security supervisor indicating that one or more security personnel did not visit a particular watch station within a predetermined window of time.

SUMMARY

The system and method of the present invention enables tracking rounds of security personnel, reporting on the completion of rounds of the security personnel, and then providing an alert should security personnel not visit a watch station within a predetermined window of time.

By using a two-way wireless communication from keypad located at each watch station, security personnel can input and transmit a predetermined identifying code each time the watch station is visited. Further, security personnel will be able to input an array of reporting information to include a code or codes indicating any observed condition. If an emergency or critical situation is encountered, a "panic button" is provided.

Input from the keypad at each watch station is either transmitted directly or relayed in a wireless manner to a server. Data residing in the memory of the server will be able to identify and record the watch station from which the input from the security personnel has been sent, the time of transmission of the input, and any information or special codes provided by security personnel. It will then be possible to compare that data against a set of permissible parameters. In addition to recording input at the keypad at each watch station, the software program residing at the server will be able to determine if the anticipated input from the security personnel has not been provided within a predetermined widow of time. When no input is provided within a predetermined period of time, an alert is sent to a dispatcher, security manager, or third party responder. The dispatcher, security manager, or third party responder may then check on the security personnel or relay the alert to any other organization on a predetermined list of parties to be notified should presence at a watch station be missed or a code relating to a particular condition be entered. Such parties may include local police, another security agency, fire personnel, hazardous material spill response team, or a remote security administrator at a corporate headquarters location.

Each enterprise using the disclosed system and method would have access to the server, the software program for receiving information and providing reports, and the data resident therein. Thus, each enterprise employing the disclosed system and method would be able to record the identification and location of each watch station and the desired window of time at which that watch station should be visited by security personnel. Further, the security manager for the location where security personnel are making their rounds could request a variety of different reports to determine the effectiveness of the security personnel. To assure proper operation and implementation of any changes or upgrades, only a predetermined list of personnel would have access to the server, the software program, and any security-related data resident therein.

BRIEF DESCRIPTION OF THE DRAWING FIGURE

A better understanding of the system and method of the present invention may be had by reference to the drawing figures, wherein:

FIG. 3 is a sample report.

DESCRIPTION OF THE EMBODIMENTS

Figure 1:
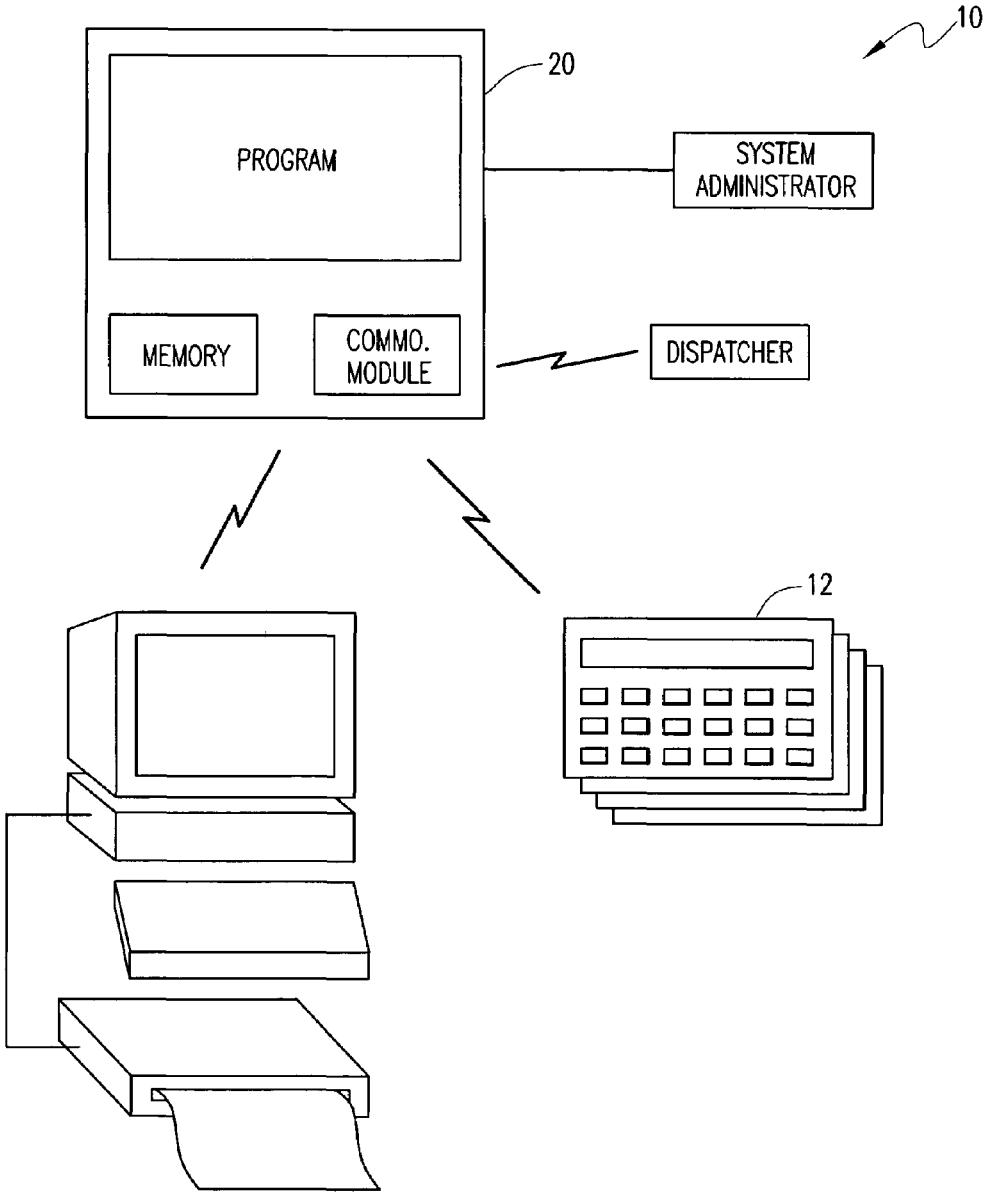
FIG. 1 is a schematic view of the system and method of the present invention.

As shown in FIG. 1, the present system 10 and method for managing the time and security provided by watch services is built around the use of a keypad assembly 12 in the preferred embodiment, for receiving and forwarding input indicating the physical presence, and the time of that presence by security personnel.

The system 10 and method of the present invention operates by providing a wireless communication system for security personnel or any personnel required to be at a predetermined location within a prescribed window of time for recording the time when a visit to a predetermined location, typically a watch station, occurs. By use of commonly available wireless techniques, a qualifying entry input such as an employee identification number at the communication device establishes the communication link for recording the presence and, if needed, other information about the observations of the person physically present at the location where the keypad is installed.

Figure 2:
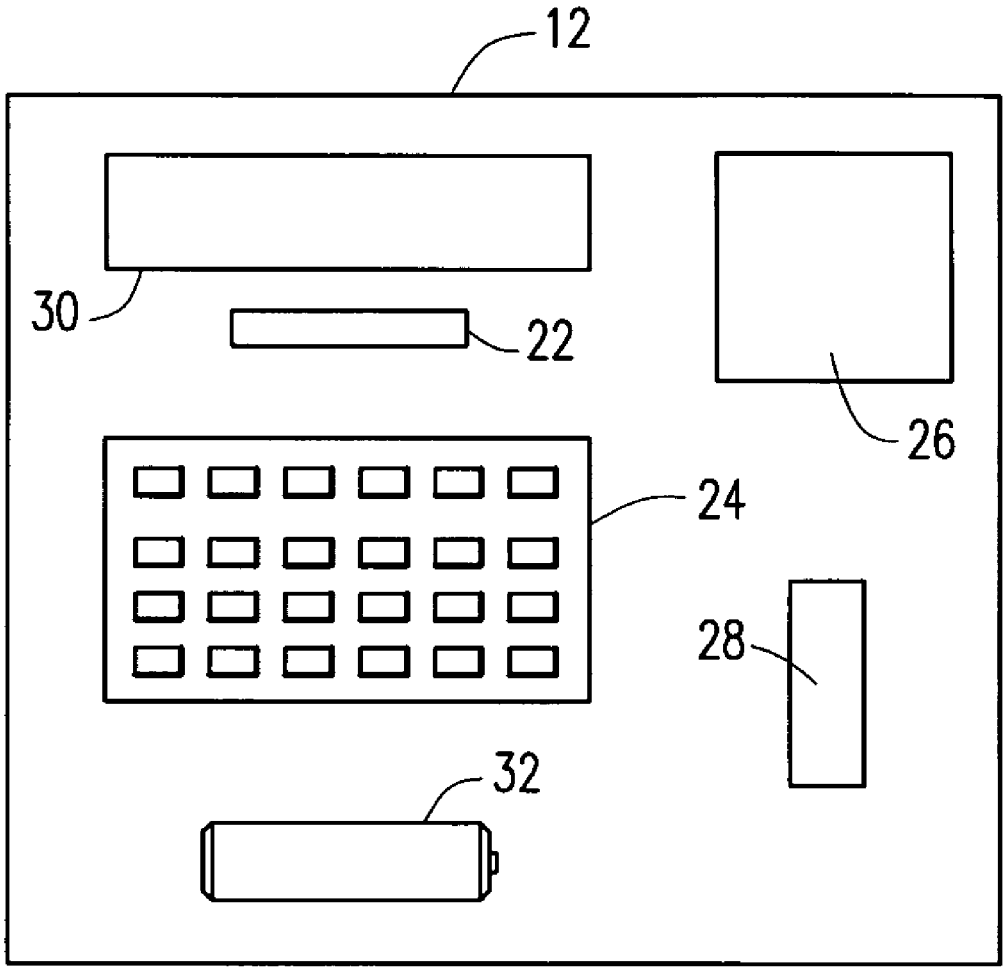
FIG. 2 is a schematic view of the portions of the keypad.

As shown in FIG. 2, the keypad assembly 12 may include a panic button 22 in addition to a keyboard 24. The panic button 22 communicates an emergency condition or sounds an alarm requiring response by a police department, fire department, or some other type of emergency condition response team. In yet another embodiment, the keypad assembly 12 may be used to provide selected messages to monitoring personnel by code or in open text. All inputs are transmitted by a module 26. Such transmissions may be wireless or through wires and may be through, for example, email, cellular telephone or satellite. Internal operation of the keypad assembly 12 is controlled by a microprocessor 28 which effects the wireless operation of the keypad assembly 12 including both the transmission and receipt of wireless messages.

Once the desired message has been entered into the keyboard 24 and transmitted wirelessly either directly or through a series of nodes to a server 20, the software program installed on either the nodes or the server 20 enables organizing the information to provide a wide variety of reports. Specifically, the reports may include activity by employee, by location, by time, by client, or even by threat level. If a threat or emergency situation is encountered by the person at the location of the keypad assembly, this condition may then be forwarded to appropriate response personnel. An example of a report appears at FIG. 3.

Each business or enterprise using the software program resident on the server 20 will have access to and control of its own data. Thus, there is no need for each user or enterprise to establish its own computer system or to buy its own software program. Further, the reports can be provided in any format desired by the user and then be sent by e-mail or hard copy to make a permanent record of the visit and messages sent by the security personnel visiting a watch station.

A wide variety of special input keys may be located at the keypad at each watch station if desired. Such keys may include: inspection made, supervisor key, reference to incident report, on duty, on site, off duty, off site, clock in, clock off, or any one of a wide variety of other commonly used inputs. Input keys may also allow for input of biometric impression information such as a thumbprint. Alternatively, a display panel 30 may produce a series of prompts requesting specific information such as location, time, verification code, biometric information, or threat level such as red, yellow, or green.

The most critical piece of information provided by the system and method of the present invention occurs when an inspection does not occur within a predetermined window of time. Such event creates an alert condition which can only be cleared by a system administrator using criteria provided by the enterprise having control over the watch stations.

The keypad assembly 12 may be powered by a battery 32, solar power, or linked directly into electrical power at the location being checked. Further, the input keyboard 24 may be protected by some type of tamperproof housing and illuminated if located in a location with no light or low light. If desired, the keypad assembly 12 and tamperproof housing may be firmly affixed in one location by any one of a wide variety of different mounting techniques—which mounting techniques are not easily tampered with or defeated.

Operation

The system and method of the present invention is best understood by reference to FIG. 1. The process begins by the enterprise entering into the software program resident in the server 20 the permissible parameters of watch stations to be visited, including the time and date of the required inspections, and the window of time during which the visits to the watch stations are to occur.

Following the entry of the information concerning the inspections into the software program, security personnel are able to identify themselves by a code, employee number, or biometric impression such as, for example, a thumbprint, when the keypad assembly 12 at each individual watch station is visited. The entry of a code at the watch station signals the server 20 and a dispatcher, if required, that the required inspection has been made and the time.

Should an inspection not be made during the window of timeframe predetermined for the inspection, a dispatcher or security monitor is alerted that the inspection has not occurred. This alert continues until a proper inspection is made and logged into the software program resident on the server 20.

If for some reason the keypad is damaged, destroyed, or removed from its location, the computer software program resident on the server 20 will be notified by failure of the inspection to occur. This failure triggers an alert condition and an appropriate resolution of the alert condition.

An alert that an inspection has not occurred is deemed to be a critical event and can be deleted solely by a small list of authorized personnel such as the system administrator operating the software program on the server 20.

Reports may be produced in any format determined by the user of the software program. Once the report format has been put into the software program and resident in the memory portion of the server 20, it cannot be changed or altered in any way. The security administrator at the enterprise where the keypad assembly 12 are located logs into the system the identity and location of each keypad assembly 12. If desired, further detailed information concerning the inspection site may also be recorded.

Because of the flexibility and adaptability of the disclosed system and method, it may be used at a wide variety of locations to include:

| | |
|---|---|
| Residences | Highway picnic or rest stops |
| Remote locations | Construction sites |
| Convenience stores | Grocery or retail stores |
| Restaurants | Office buildings |

While the present system and method has been described for use by security personnel, those of ordinary skill in the art will understand that it may be used in a wide variety of applications, including but not limited to residential, military, transportation, or any other application where it is necessary to assure the presence of a person at a predetermined location within a prescribed window of time.

I claim:

1. A method for tracking persons, said method comprising:

receiving input from persons in a location at a certain time;

transmitting said input, said location, and said time to a server wherein said server provides access to a software program for receiving information, providing reports and storing data and wherein said software program prevents the change or alteration of a report;

comparing said input, said location and said time to a predetermined set of permissible parameters for said input, said location and said time; and providing an alert if one or more of said input, said location or said time do not fall within said permissible parameters.

2. A system for tracking persons comprising:

receiving input from persons;

transmitting said input, the location of said input, and the time of said input to a server wherein said server provides access to a software program for receiving information, providing reports and storing data and wherein said software program prevents the change or alteration of a report;

comparing said input said location and said time to a predetermined set of permissible parameters for said input, said location and said time; and providing an alert if one or more of said input, said location or said time do not fall within said permissible parameters.

* * * * *